US007534150B2

(12) United States Patent
Shen et al.

(10) Patent No.: US 7,534,150 B2
(45) Date of Patent: May 19, 2009

(54) ELECTRICAL CONNECTOR WITH IMPROVED HOUSING

(75) Inventors: Guo-Jian Shen, Kunshan (CN); Jun-Jian Zhang, Kunshan (CN); Ren-Chih Li, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/973,820

(22) Filed: Oct. 9, 2007

(65) Prior Publication Data

US 2008/0085637 A1 Apr. 10, 2008

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 4,944,688 A * 7/1990 Lundergan ..... 439/275
5,035,648 A * 7/1991 Kuiper-Moore ..... 439/595
5,037,336 A * 8/1991 Betsui ..... 439/752
5,059,142 A * 10/1991 Ohta et al. ..... 439/752
5,145,419 A * 9/1992 Yamanashi et al. ..... 439/752
RE34,539 E * 2/1994 Aoyama ..... 439/752
5,458,511 A * 10/1995 Sasai et al. ..... 439/752
5,511,984 A * 4/1996 Olson et al. ..... 439/79
5,522,740 A * 6/1996 Plocek et al. ..... 439/752
5,554,055 A * 9/1996 Miller ..... 439/752
5,713,746 A * 2/1998 Olson et al. ..... 439/79
5,879,192 A * 3/1999 Machida et al. ..... 439/598
5,957,732 A * 9/1999 Ito et al. ..... 439/752
6,012,930 A * 1/2000 Tokuwa et al. ..... 439/79
6,146,200 A * 11/2000 Ito et al. ..... 439/596
6,149,462 A * 11/2000 Sugie ..... 439/595
6,296,530 B1 * 10/2001 Yoneda et al. ..... 439/701
6,361,373 B1 * 3/2002 Horchler ..... 439/701
6,468,113 B1 * 10/2002 Murakami et al. ..... 439/752
6,585,543 B2 * 7/2003 Kuroda et al. ..... 439/752
6,648,697 B2 * 11/2003 Yang ..... 439/701
6,749,444 B2 * 6/2004 Murr et al. ..... 439/79
6,887,112 B2 5/2005 Kuroki et al.
7,281,961 B1 * 10/2007 Sugiyama et al. ..... 439/752
7,341,486 B2 * 3/2008 Onoda et al. ..... 439/595
2001/0029132 A1 * 10/2001 Kuroda et al. ..... 439/752
2003/0194915 A1 * 10/2003 Yang ..... 439/752

(Continued)

*Primary Examiner*—Ross N Gushi
(74) *Attorney, Agent, or Firm*—Wei Te Chung

(57) ABSTRACT

An electrical connector (100) comprises a first insulative housing (10) comprising a base section (110) extending along a first direction and defining a front end and a rear end thereof in a second direction vertical to the first direction. A mating section (120) extends forward from the front end of the base section in the second direction and a mating cavity (121) is defined in the mating section and opened forward. A receiving chamber (140) is provided in the rear end of the base section (110) and opened rearward. A plurality of terminal grooves (130) is arranged along the first direction and extends along the second direction. A second insulative housing (20) is received and retained in the receiving chamber (140) of the first insulative housing (10) with a plurality of passageways (210) corresponding with and aligning with said terminal grooves (130) in the second direction. A plurality of terminals (30) is retained in the terminal grooves and the passageways.

12 Claims, 9 Drawing Sheets

U.S. PATENT DOCUMENTS

2004/0110427 A1* 6/2004 Shi et al. ..... 439/752
2004/0235365 A1* 11/2004 Fujita ..... 439/752
2005/0095921 A1* 5/2005 Nishide ..... 439/752
2005/0142955 A1* 6/2005 Horiuchi ..... 439/752
2005/0272316 A1* 12/2005 Miksche et al. ..... 439/752
2006/0223382 A1* 10/2006 Ho ..... 439/752
2007/0155254 A1* 7/2007 Daudin et al. ..... 439/752

* cited by examiner

ELECTRICAL CONNECTOR WITH IMPROVED HOUSING

BACKGROUND OF THE INVENTION

1. Field of the Invention

The present invention relates to an electrical connector which comprises a first and a second housing.

2. Description of Related Art

A conventional electrical connector 10' is introduced referring to FIGS. 8 and 9, which comprises an insulative housing 1' with a plurality of terminals 2' mounted thereon and a shield 3' surrounding the insulative housing. The insulative housing comprises a base section and a mating section extending forward from the base section and defining a receiving space 11' therein. Each terminal 2 comprises a contacting portion exposed to the receiving space and a solder portion projecting out of the insulative housing.

FIG. 9 is a cross-sectional view of FIG. 8 taken along line 9-9, which discloses an inner structure of the insulative housing. The insulative housing defines a plurality of grooves 12' extending forward from a rear side of the base section until communicating with the receiving space. The grooves are arranged at a fixed interval and form a plurality of ribs 13' therebetween. To keep a steadily connection between the electrical connector and a mating connector, the mating section should extend a long distance in a mating direction (figured as a). As the shield is retained on the base section of the housing, the base section of the housing also extends a long distance (figured as b) to provide enough retaining area. As a result, the length (figured as c) of the electrical connector in the mating direction is too long and so is the corresponding ribs. However, the ribs with long distance are easy to break down during moulding procedure of the housing. Therefore, a new design which can overcome the problems is required.

SUMMARY OF THE INVENTION

An object of the present invention is to provide an electrical connector with an improved housing.

In order to achieve above-mentioned objects, an electrical connector comprises a first insulative housing, a second insulative housing and a plurality of terminals retained in said housings. The first insulative housing comprises a base section extending along a first direction and defining a front end and a rear end thereof in a second direction vertical to the first direction. A mating section extends forward from the front end of the base section in the second direction and a mating cavity is defined in the mating section and opened forward. A receiving chamber is provided in the rear end of the base section and opened rearward. A plurality of terminal grooves is arranged along the first direction and extends along the second direction. A second insulative housing is received and retained in the receiving chamber of the first insulative housing with a plurality of passageways corresponding with and aligning with said terminal grooves in the second direction. The terminals are retained in the terminal grooves and the passageways.

Other objects, advantages and novel features of the present invention will become more apparent from the following detailed description of the present embodiment when taken in conjunction with the accompanying drawings.

DETAILED DESCRIPTION OF THE INVENTION

Figure 1:
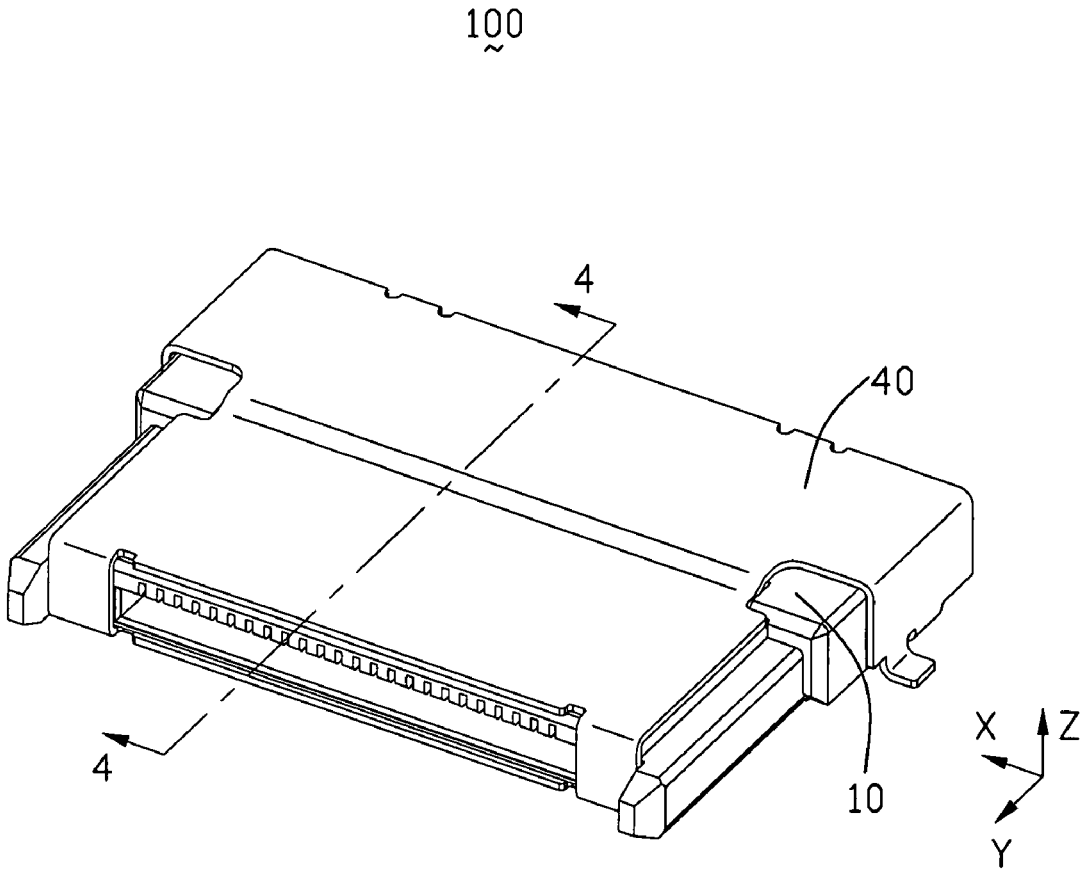
FIG. 1 is an assembled perspective view of the electrical connector in accordance with the present invention.

Reference will now be made to the drawing figures to describe the preferred embodiment of the present invention in detail.

Figure 2:
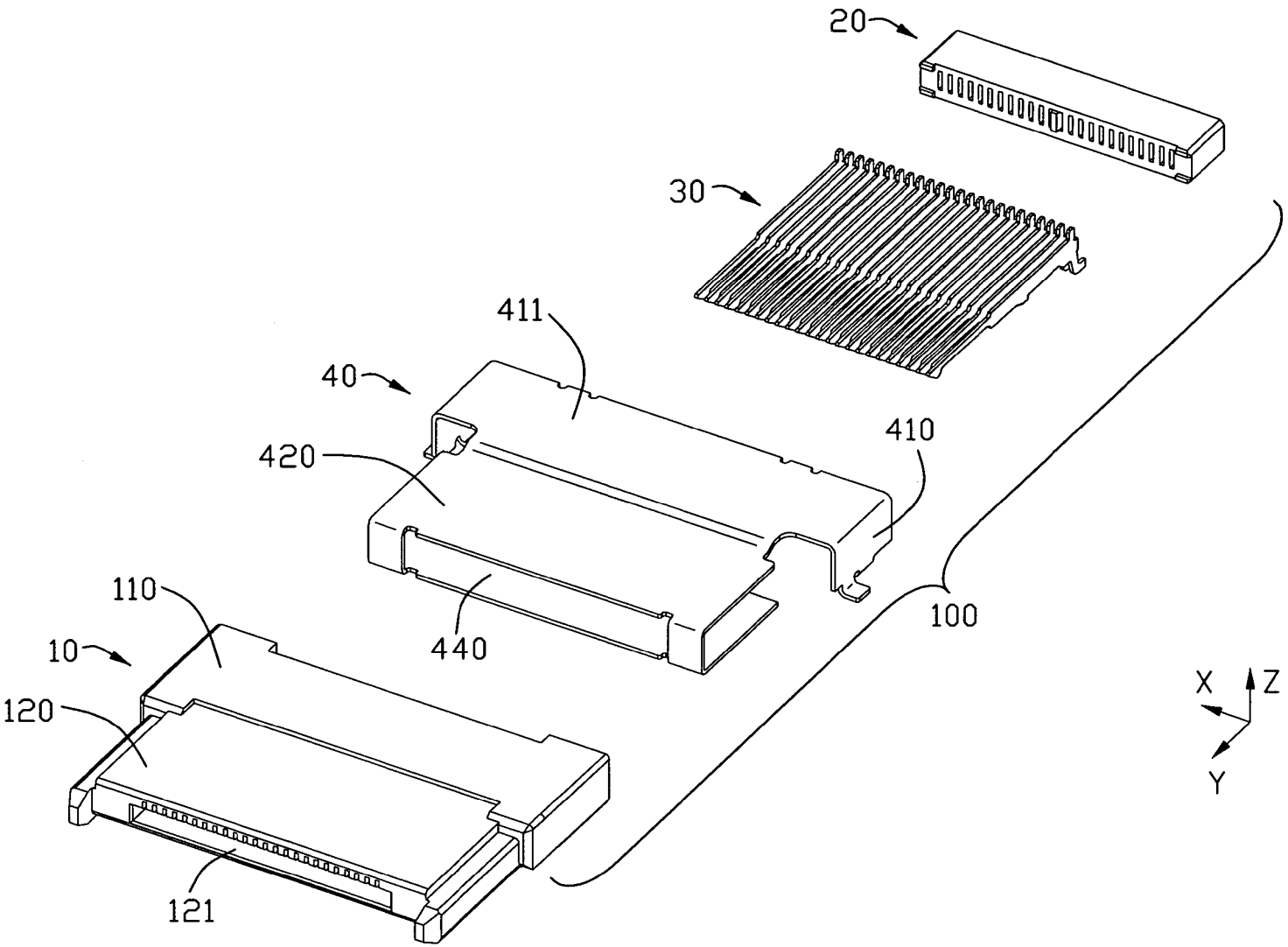
FIG. 2 is an exploded perspective view of the electrical connector shown in FIG. 1.

Referring to FIGS. 1 and 2, an electrical connector 100 comprises a first insulative housing 10, a second insulative housing 20, a plurality of terminals 30 and a shell 40 surrounding the first and the second insulative housing.

Figure 5:
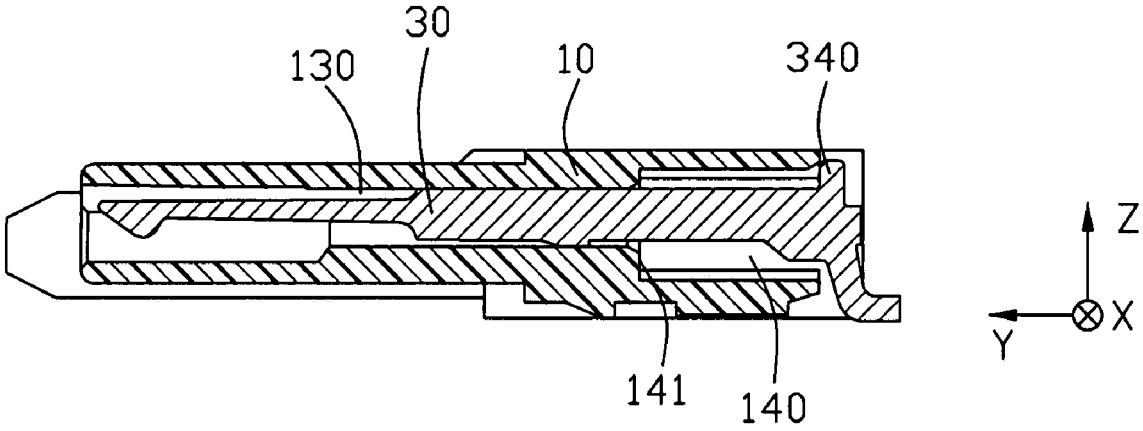
FIG. 5 is a similar view of FIG. 4 with a second housing and a shell removed.
Figure 6:
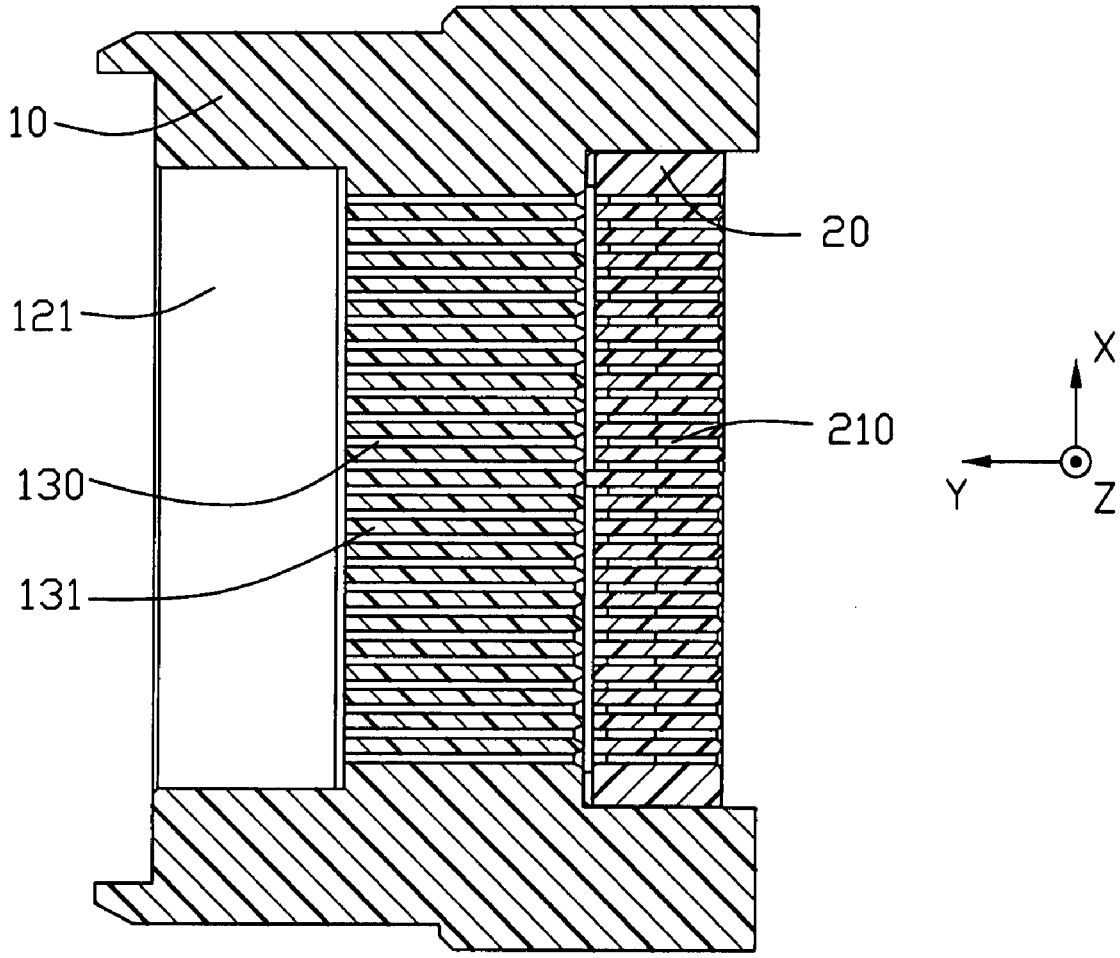
FIG. 6 is a cross-sectional view of the electrical connector shown in FIG. 4 taken along line 6-6, which discloses the combination of a first housing and the second housing.

As shown in FIG. 2, the first insulative housing 10 comprises a base section 110 extending along a first direction ("X" direction). The base section 110 defines a front end and a rear end in a second direction ("Y" direction) vertical to the X direction. A mating section 120 extends forward from the base section. The mating section 120 defines a mating cavity 121 in the front portion thereof for receiving a mating connector (not shown). See FIGS. 5 and 6, a plurality of terminal grooves 130 runs through the insulative housing in the Y direction, which is arranged parallel and spaced along the X direction with predetermined distance, and a rib 131 is formed between every two adjacent grooves (best shown in FIG. 6). A receiving chamber 140 is recessed from the rear end of the base section 110 for receiving the second insulative housing 20, which will be described hereafter. The receiving chamber 140 is surrounding by an upper wall, a lower wall, an inner wall 141 and two side walls.

Figure 7:
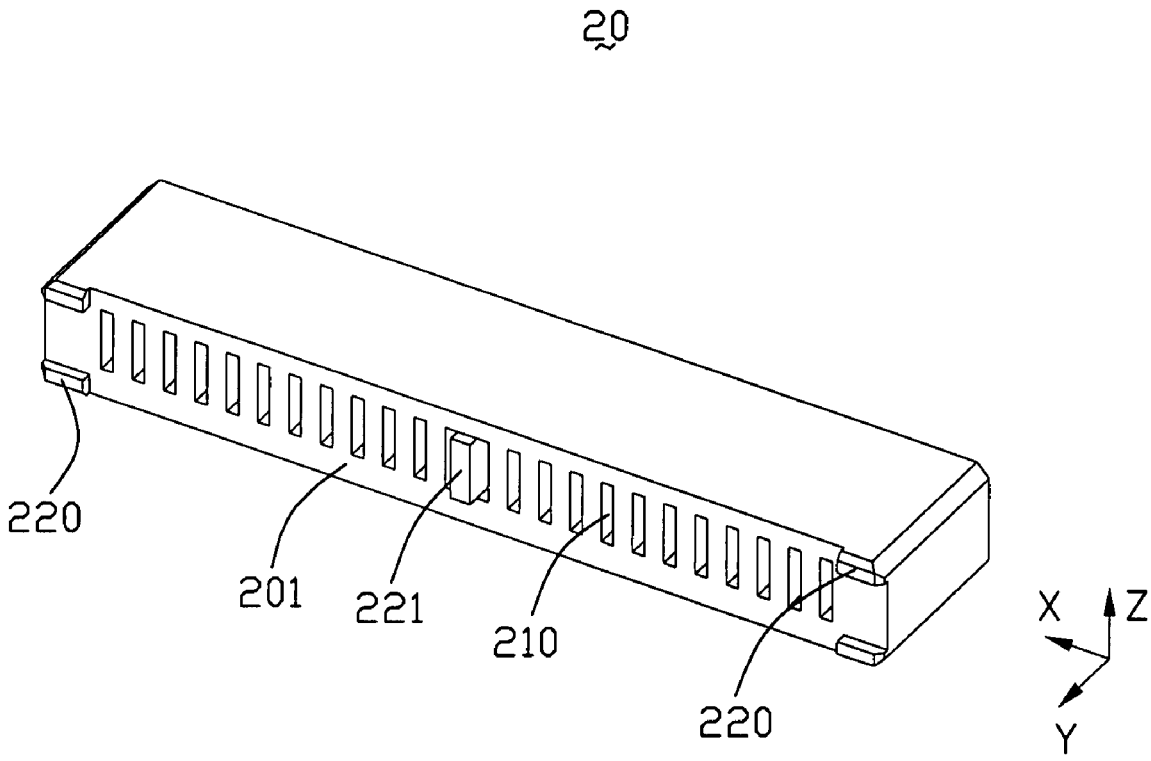
FIG. 7 is a perspective view of the second housing.
Figure 8:
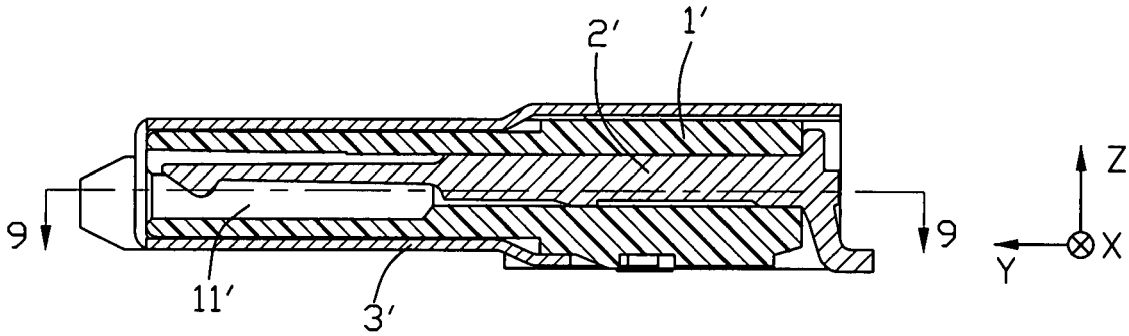
FIG. 8 is a perspective view of a conventional electrical connector.
Figure 9:
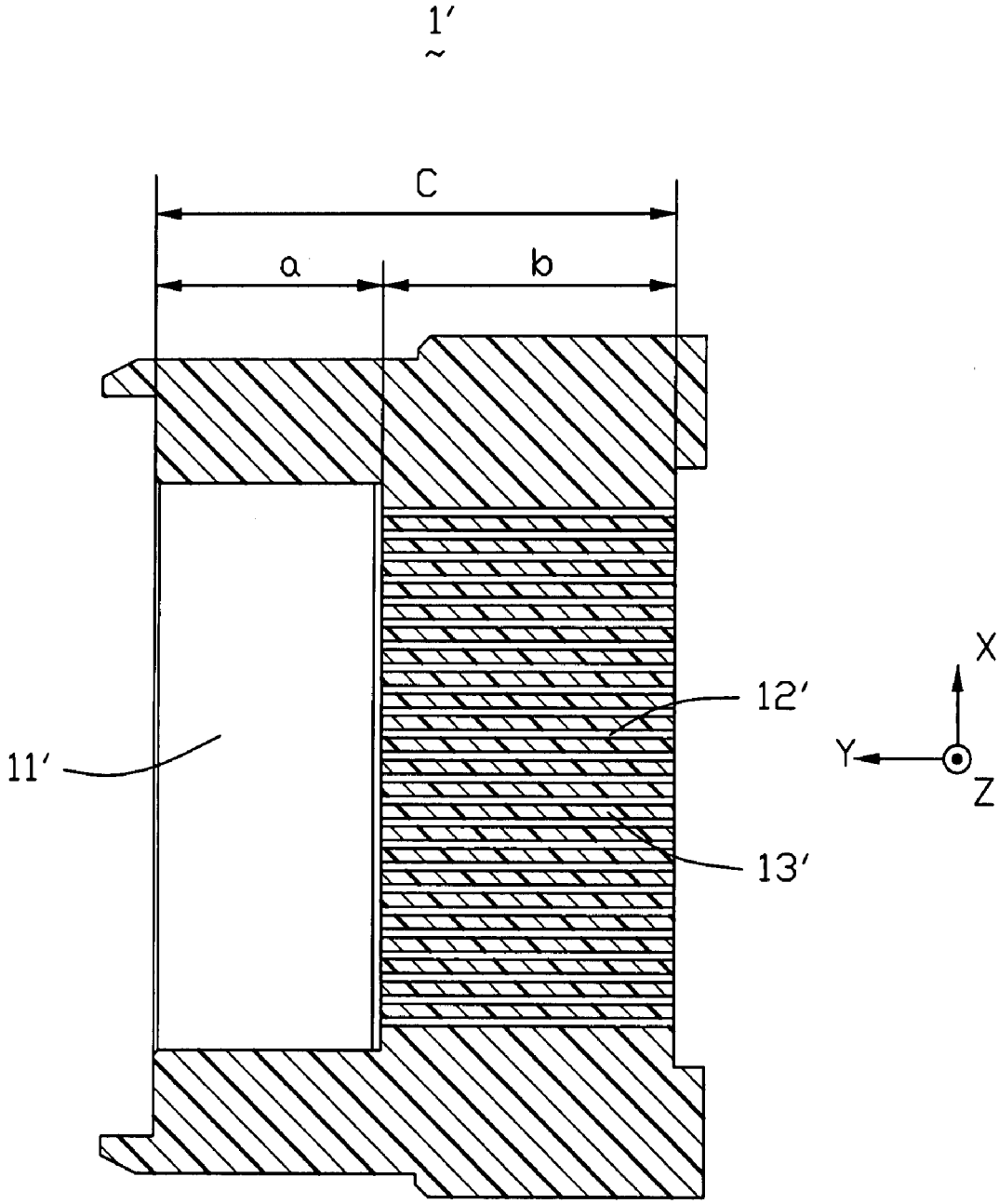
FIG. 9 is a cross-sectional view of the electrical connector shown in FIG. 8 taken along line 9-9, which discloses an inner structure of a first insulative housing.

As shown in FIG. 7, the second insulative housing 20 is a rectangular frame body with a front surface 201. At each ends of the front surface 201, two spaced protrusions 220 are formed, and in the middle of the front surface 201, a protrusion 220 is also formed vertical to said protrusion. The protrusions 220 are engaging with an inner wall 141 to ensure the coplanarity of the interface of the first and the second insulative housing, see FIG. 4. A plurality of passageways 210 runs through the second housing in the Y direction, which is set at a fixed interval and aligned and communicating with the terminal grooves 130 of the first insulative housing 10, see FIG. 6. See FIG. 4, each passageway 210 defines a front opening 211 and a back opening 212 in the Y direction, and the size of the back opening in a third direction vertical to the first and second direction ("Z" direction) is wider than the front opening, which is convenient for the terminal 30 to be inserted into.

Figure 4:
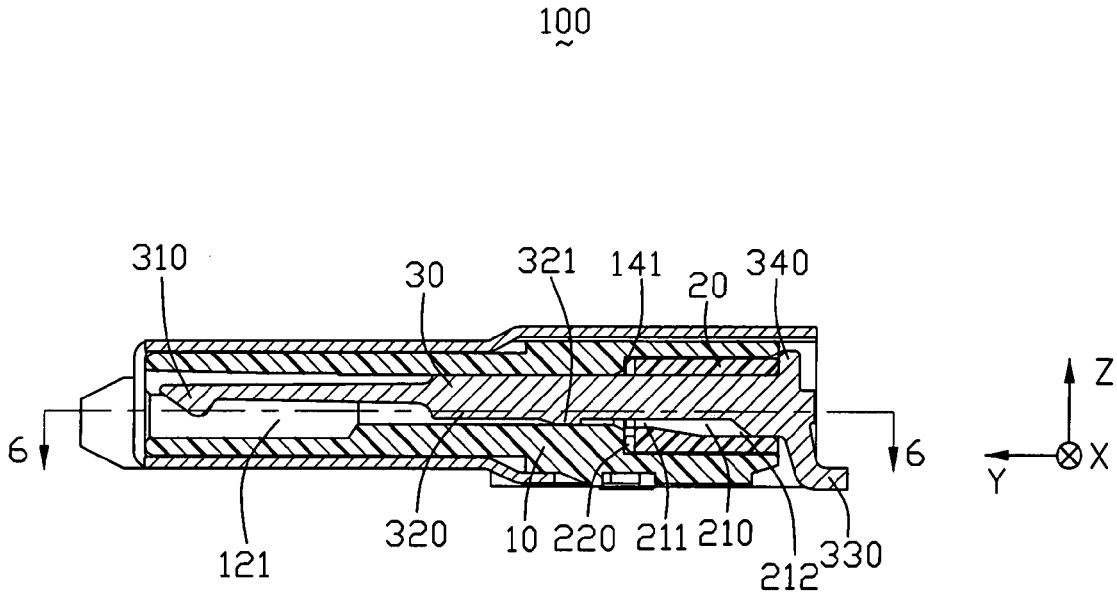
FIG. 4 is a cross-sectional view of the electrical connector shown in FIG. 1 taken along line 4-4.

Referring to FIG. 4, the terminals 30 are inserted into the passageways 210 and the terminal grooves 130 along the Y direction. The terminal 30 is made by stamping a single piece of metal plate and each comprises a retaining portion 320 engaged with the passageways 210 and grooves 130. A contacting portion 310 of the terminal extends forward from the retaining portion and is exposed in the mating cavity 121 to contact with the mating connector. A stopper portion 340 of the terminal projects upward from a rear end of retaining portion 320 to prevent the terminal from forward moving while assembly. A soldering portion 330 projects downward out of the housing. A plurality of tips 321 are formed on the retaining portion 320 to engage with the terminal groove 130 to fix the terminal in the groove.

Figure 3:
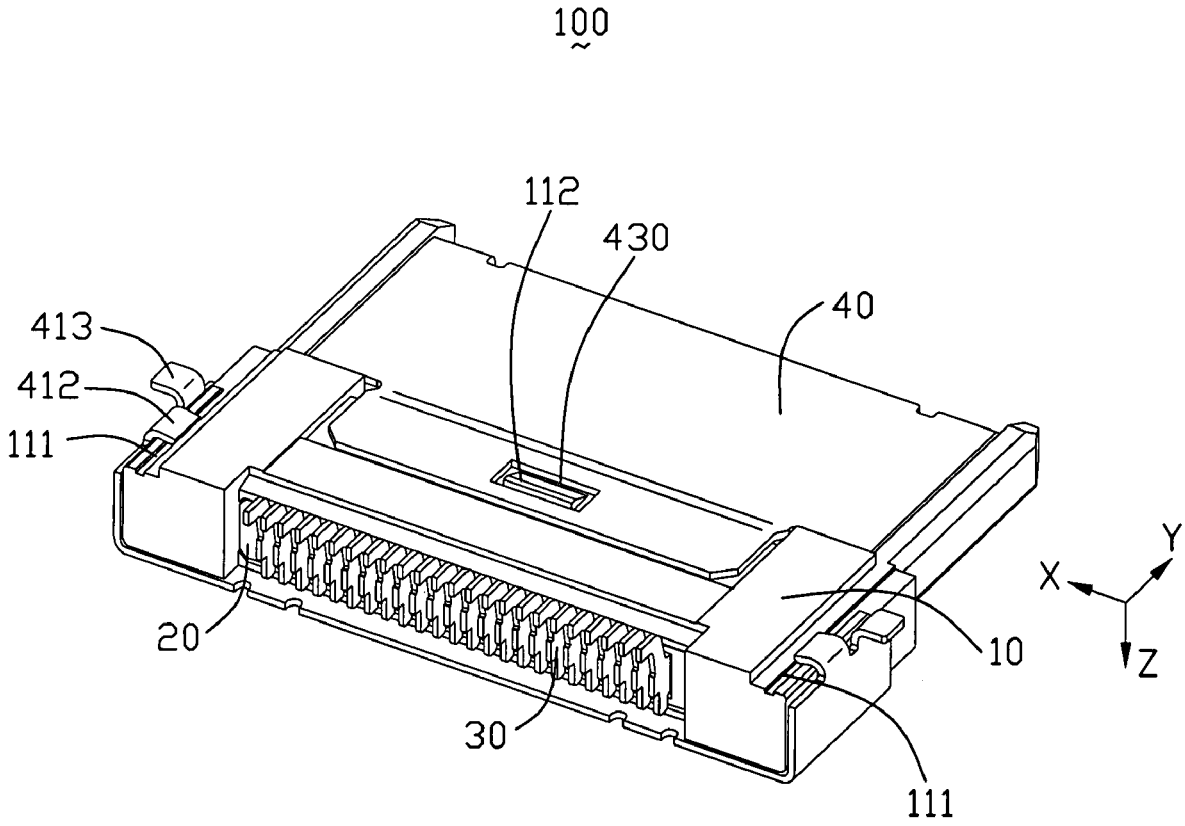
FIG. 3 is another view of the electrical connector shown in FIG. 1.

Referring to FIGS. 1 and 2, the shell 40 is made from a piece of metal sheet and comprises a rear portion 410 covering the upper surface of the base section 110 and a front portion 420 surrounding the mating section 120. The rear portion defines a pair of side walls 411 bending from a top wall thereof. A locking portion 412 bents inward at each side wall to engage with a locking groove 111 defined at each end of the first insulative housing 10 and a soldering leg 413 bends outward at each side wall to connect with a printed circuit board (see FIG. 3). The front portion 420 is configured with an upper and a lower wall with an opening 440 corresponding to the mating cavity of the housing. A locking opening 430 is formed in the lower wall to buckle with a protrusion 112 formed on a lower wall of the base section 110.

Referring to FIG. 4, the second insulative housing 20 is received in the first insulative housing 10 and the terminal 30 is then retained in said two housings. The height of the second insulative housing 20 in the Z direction is larger than that of the receiving chamber 140, so that the second insulative housing 20 is fixedly retain in the receiving chamber with friction force after being pushed into the chamber. The terminal 30 is first inserted into the passageway 210 and then into the terminal groove 130 until the stopper portion 340 abuts against the back end of the second insulative housing. The passageways 210 are aligned with the terminal grooves 130 and the passageways are higher than the terminal grooves in the Z direction so that the insertion operation is simple.

In the present invention, the rib between every two adjacent terminal grooves is divided into two parts, which can availably avoid broken down of the ribs during modeling the housing. Furthermore, the structure of the electrical connector is more compact via the cooperation of the first and second insulative housing.

Another embodiment of the present invention is introduced hereafter. The terminals 30 are modeled in the second insulative housing 20 forming a terminal module, and then the terminal modular is inserted into the receiving chamber 140 to engage with the first insulative housing 10 with the terminals 30 extending along the terminal grooves 130.

The present invention is not limited to the electrical connector mentioned above. This disclosure is illustrative only, changes may be made in detail, especially in matter of shapes, size, and arrangement of parts within the principles of the invention.

What is claimed is:

1. An electrical connector comprising:

a first insulative housing comprising a base section extending along a first direction and defining a front end and a rear end thereof in a second direction vertical to the first direction, a mating section extending forward from the front end of the base section in the second direction, a mating cavity being defined in the mating section and opened forward and a receiving chamber being provided in the rear end of the base section and opened rearward, a plurality of terminal grooves being arranged along the first direction and extending along the second direction;

a second insulative housing received and retained in the receiving chamber of the first insulative housing with a plurality of passageways corresponding with and aligning with said tenninal grooves in the second direction; and a plurality of terminals retained in the terminal grooves and the passageways;

wherein the second insulative housing forms at least two protrusions in a front surface coplanar with an inner wall of chamber.

2. The electrical connector as described in claim 1, wherein the second insulative housing is slightly higher than the chamber so that the second insulating is fixedly retained in the chamber.

3. The electrical connector as described in claim 1, wherein said passageways are higher than the terminal grooves in a third direction both vertical to the first and second directions.

4. The electrical connector as described in claim 1, wherein each passageway of the second insualtive housing defines a front end and a rear end in the second direction, and the rear end is slightly higher than the front end.

5. The electrical connector as described in claim 1, wherein the second insulative housing is shorter than the first insulative housing in the second direction.

6. The electrical connector as described in claim 1, wherein a shell is provided surrounding the first and second housing, the shell comprises a front portion and a rear portion, said front portion covers the mating section and said rear portion surrounds the base portion.

7. The electrical connector as described in claim 1, wherein each terminal comprises a retaining portion retained in the terminal groove and passageways.

8. The electrical connector as described in claim 7, wherein each terminal comprises a contacting portion extending forward from the retaining portion and being exposed in the mating cavity.

9. The electrical connector as described in claim 8, wherein each terminal comprises a stopper portion extending rearward and projecting upward out of the second housing.

10. An electrical connector comprising:

a first insulative housing having a mating cavity in a front portion and a receiving cavity in a rear portion communicating with each other along a front-to-back direction via a plurality of first passageways;

a second insulative housing retainably received in the receiving cavity and defining a plurality of second passageways in alignment with the corresponding first passageways in said front-to-back direction; and a plurality of contacts inserted into the second housing from a rear face of the second housing with a tail portion exposed outside of the rear face of the second housing, a mating portion exposed in the mating cavity, and an intennediate portion located between said tail portion and said mating portion; wherein said intermediate portion is fixed within at least one of the corresponding first passageway and second passageway; wherein said contact further includes an expanded stopper at a rear portion which forwardly abuts at least one of said first housing and said second housing.

11. The electrical connector as claimed in claim 10, wherein said first housing defines a rear face which is essentially aligned with the rear face of the second housing.

12. An electrical connector comprising:

a first insulative housing defining a mating cavity and a plurality of first passageways along a front-to-back direction to communicate with said mating cavity;

a second insulative housing retained to the first housing and defining a plurality of second passageways in alignment with the corresponding first passageways in said front-to-back direction; and a plurality of contacts inserted into the second housing from a rear face of the second housing with a tail portion exposed outside of the rear face of the second housing, a mating portion exposed in the mating cavity, and an intermediate portion located between said tail portion and said mating portion; wherein said intermediate portion is fixed within both the corresponding first passageway and second passageway;

wherein said contact further includes an expanded stopper at a rear portion around the tail portion, which forwardly abuts said second housing.

* * * * *